US006308594B1

(12) United States Patent
Cheng

(10) Patent No.: US 6,308,594 B1
(45) Date of Patent: Oct. 30, 2001

(54) RATCHET WRENCH STRUCTURE

(76) Inventor: Chin-Shun Cheng, No. 4, Lane 326, Peng-I Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/749,518

(22) Filed: Dec. 28, 2000

(51) Int. Cl.[7] ..... B25B 13/46
(52) U.S. Cl. ..... 81/62; 81/63.1
(58) Field of Search ..... 81/60, 61, 62, 81/63, 63.1, 63.2

(56) References Cited

U.S. PATENT DOCUMENTS

| | | | | |
|---|---|---|---|---|
| 2,803,980 | * | 8/1957 | Vogel | 81/62 |
| 3,598,001 | * | 8/1971 | Thomasian | 81/63.1 |
| 6,065,374 | * | 5/2000 | Taggart | 81/63.2 |
| 6,164,167 | * | 12/2000 | Chen | 81/63.2 |

* cited by examiner

*Primary Examiner*—Joseph J. Hail, III
*Assistant Examiner*—Joni B. Danganan
(74) *Attorney, Agent, or Firm*—Rosenberg, Klein & Lee

(57) ABSTRACT

A ratchet wrench structure includes a wrench head defining a receiving hole, the receiving hole having one side defining a receiving chamber, a ratchet wheel rotatably mounted in the receiving hole and having an outer periphery provided with a plurality of engaging teeth, a pawl pivotally mounted in the receiving chamber to rotate through a small angle and having a first side provided with a first tooth meshing with the engaging teeth of the ratchet wheel and a second side provided with a second tooth meshing with the engaging teeth of the ratchet wheel, a first locking plate mounted in the receiving chamber and rested on the first side of the pawl, a first elastic member mounted in the receiving chamber and pressed between the first locking plate and an inner wall of the receiving chamber, a second locking plate mounted in the receiving chamber and rested on the second side of the pawl, and a second elastic member mounted in the receiving chamber and pressed between the second locking plate and the inner wall of the receiving chamber.

7 Claims, 6 Drawing Sheets

RATCHET WRENCH STRUCTURE

BACKGROUND OF THE INVENTION

1. Field of the Invention

The present invention relates to a ratchet wrench structure.

2. Description of the Related Prior Art

A conventional ratchet wrench in accordance with the prior art comprises a wrench head defining a receiving hole and a receiving chamber, a ratchet wheel mounted in the receiving hole and provided with a plurality of teeth, a pawl pivotally mounted in the receiving chamber, a first locking plate rested on a first side of the pawl, a first spring pressed between the first locking plate and the wall of the receiving chamber, a second locking plate rested on a second side of the pawl, and a second spring pressed between the second locking plate and the wall of the receiving chamber.

In operation, the pawl member can be rotated in one direction to a first position where the first locking plate is pressed by the first spring to mesh with one of the teeth of the ratchet wheel so that the ratchet wrench is operated along one direction only. Alternatively, the pawl member can be rotated in the reverse direction to a second position where the second locking plate is pressed by the second spring to mesh with one of the teeth of the ratchet wheel so that the ratchet wrench is operated along the other direction only.

However, the locking plate is engaged with the ratchet wheel by one tooth only, thereby decreasing the engaging strength of the ratchet wheel so that such a conventional ratchet wrench cannot be used to withstand a larger torque.

SUMMARY OF THE INVENTION

In accordance with the present invention, there is provided a ratchet wrench structure comprising:

- a wrench head defining a receiving hole, the receiving hole having one side defining a receiving chamber;
- a ratchet wheel rotatably mounted in the receiving hole and having an outer periphery provided with a plurality of engaging teeth;
- a pawl pivotally mounted in the receiving chamber to rotate through a small angle and having a first side provided with a first tooth meshing with the engaging teeth of the ratchet wheel, and a second side provided with a second tooth meshing with the engaging teeth of the ratchet wheel;
- a first locking plate mounted in the receiving chamber and rested on the first side of the pawl;
- a first elastic member mounted in the receiving chamber and pressed between the first locking plate and an inner wall of the receiving chamber;
- a second locking plate mounted in the receiving chamber and rested on the second side of the pawl; and
- a second elastic member mounted in the receiving chamber and pressed between the second locking plate and the inner wall of the receiving chamber.

Further benefits and advantages of the present invention will become apparent after a careful reading of the detailed description with appropriate reference to the accompanying drawings.

DETAILED DESCRIPTION OF THE INVENTION

Figure 1:
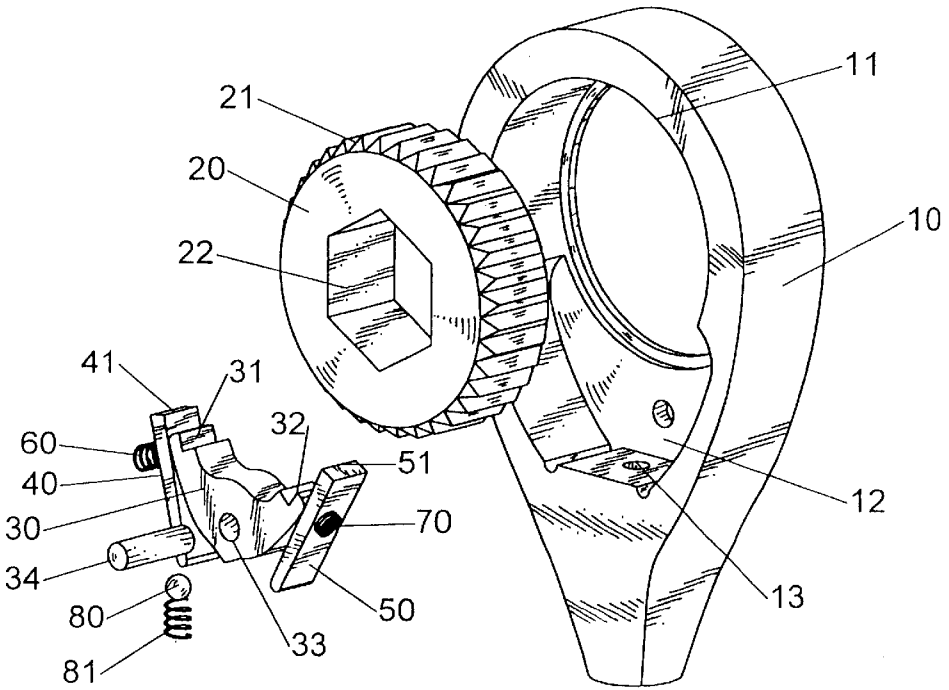
FIG. 1 is an exploded perspective view of a ratchet wrench structure in accordance with the present invention.
Figure 2:
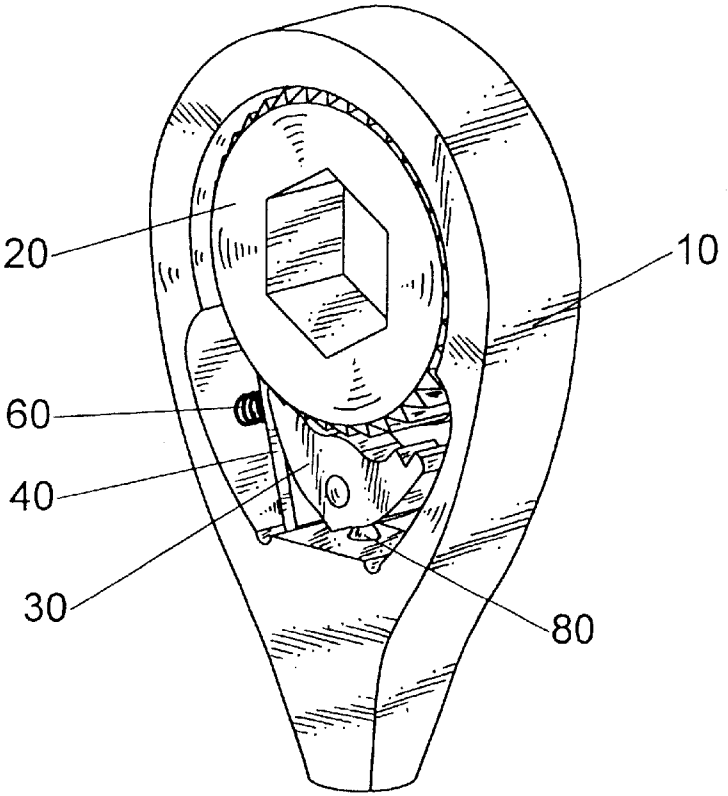
FIG. 2 is a perspective assembly view of the ratchet wrench structure as shown in FIG. 1.
Figure 3:
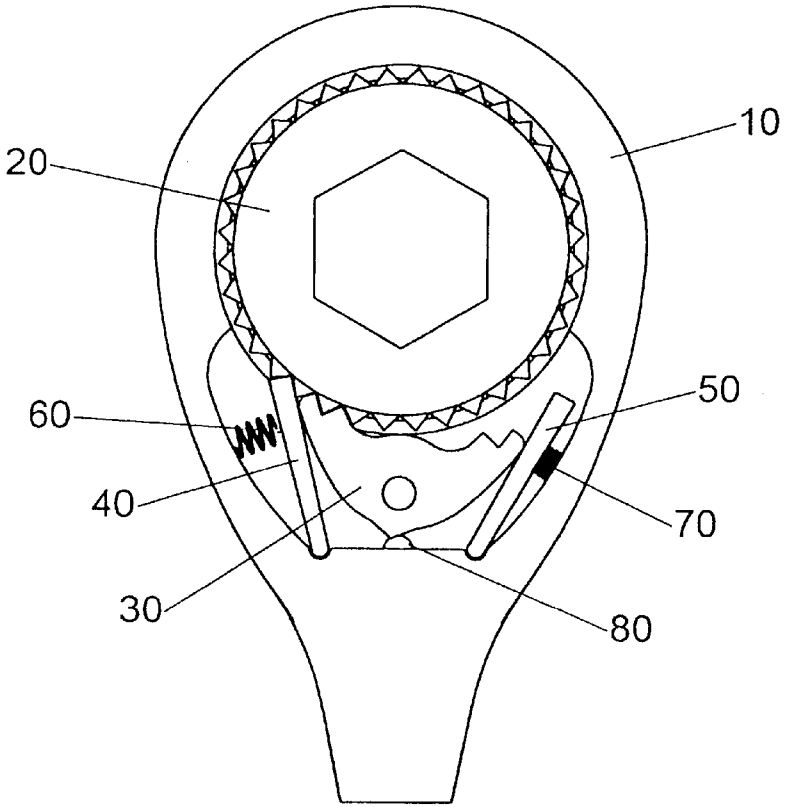
FIG. 3 is a front plan operational view of the ratchet wrench structure as shown in FIG. 2.

Referring to the drawings and initially to FIGS. 1–3, a ratchet wrench structure in accordance with the present invention comprises a wrench head 10 defining a receiving hole 11, the receiving hole 11 having one side defining a receiving chamber 12; a ratchet wheel 20 rotatably mounted in the receiving hole 11 and having a center defining polygonal recess 22 for co-operating with a screw member (not shown), and an outer periphery provided with a plurality of engaging teeth 21; a pawl 30 pivotally mounted in the receiving chamber 12 to rotate through a small angle and having a first side provided with a first tooth 31 meshing with the engaging teeth 21 of the ratchet wheel 20, and a second side provided with a second tooth 32 meshing with the engaging teeth 21 of the ratchet wheel 20; a first locking plate 40 mounted in the receiving chamber 12 and rested on the first side of the pawl 30; a first elastic member 60 mounted in the receiving chamber 12 and pressed between the first locking plate 40 and an inner wall of the receiving chamber 12; a second locking plate 50 mounted in the receiving chamber 12 and rested on the second side of the pawl 30; and a second elastic member 70 mounted in the receiving chamber 12 and pressed between the second locking plate 50 and the inner wall of the receiving chamber 12.

The ratchet wrench structure further comprises a pivot axle 34 pivotally mounted in the receiving chamber 12 and secured in the pawl 30 so that the pawl 30 is rotated with the pivot axle 34. The pawl 30 defines a hole 33 for securing the pivot axle 34 therein.

The receiving chamber 12 has a distal end defining a small hole 13, and the ratchet wrench structure further comprises a ball 80 received in the small hole 13 and rested on a bottom of the pawl 30, and a spring 81 received in the small hole 13 and pressed between the ball 80 and a wall of the small hole 13.

The first locking plate 40 has a distal end provided with a first mating tooth 41 aligning with the first tooth 31 of the pawl 30 and meshing with the engaging teeth 21 of the ratchet wheel 20. The second locking plate 50 has a distal end provided with a second mating tooth 51 aligning with the second tooth 32 of the pawl 30 and meshing with the engaging teeth 21 of the ratchet wheel 20.

In operation, referring to FIG. 3 with referring to FIGS. 1 and 2, the pivot axle 34 can be rotated by a driver member (not shown) which is secured on the pivot axle 34. When the driver member is rotated, the pivot axle 34 is rotated so as to rotate the pawl 30 through a small angle.

In such a manner, the pawl 30 can be rotated clockwise about the pivot axle 34 to the position as shown in FIG. 3 where the first tooth 31 of the pawl 30 meshes with the engaging teeth 21 of the ratchet wheel 20 while the first mating tooth 41 of the first locking plate 40 is pressed by the first elastic member 60 to mesh with the engaging teeth 21 of the ratchet wheel 20. On the other hand, the second tooth 32 of the pawl 30 is moved to detach from the engaging teeth 21 of the ratchet wheel 20 while the second locking plate 50 is pushed away by the second side of the pawl 30 to detach from the engaging teeth 21 of the ratchet wheel 20 so that the ratchet wrench is operated along one direction only.

Figure 4:
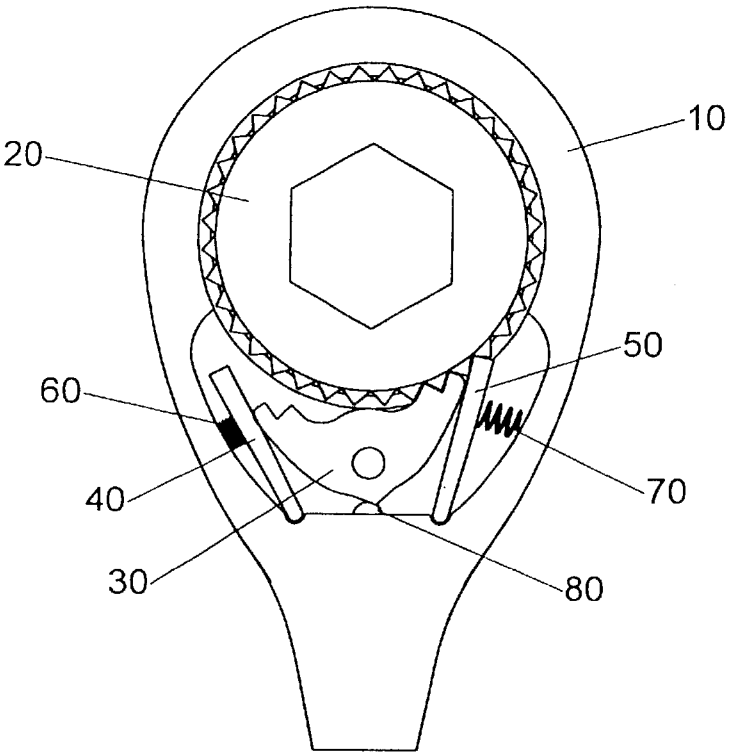
FIG. 4 is a front plan operational view of the ratchet wrench structure as shown in FIG. 2.

Referring to FIG. 4 with referring to FIGS. 1 and 2, the pawl 30 can be rotated counterclockwise about the pivot axle 34 to the position as shown in FIG. 4 where the second tooth 32 of the pawl 30 meshes with the engaging teeth 21 of the ratchet wheel 20 while the second mating tooth 51 of the second locking plate 50 is pressed by the second elastic member 70 to mesh with the engaging teeth 21 of the ratchet wheel 20. On the other hand, the first tooth 31 of the pawl 30 is moved to detach from the engaging teeth 21 of the ratchet wheel 20 while the first locking plate 40 is pushed away by the first side of the pawl 30 to detach from the engaging teeth 21 of the ratchet wheel 20 so that the ratchet wrench is operated along the other direction only.

Figure 5:
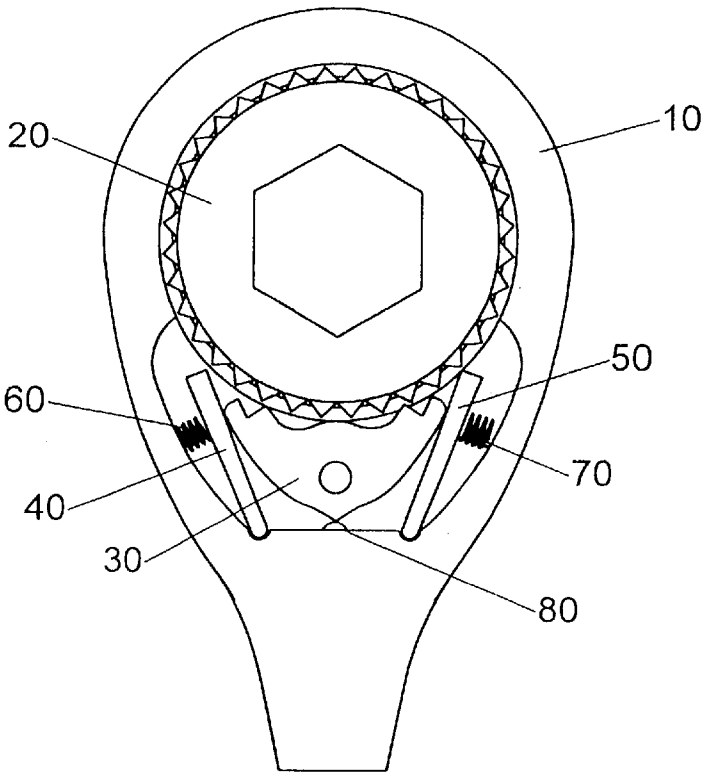
FIG. 5 is a front plan operational view of the ratchet wrench structure as shown in FIG. 2.

Referring to FIG. 5 with referring to FIGS. 1 and 2, the pawl 30 is located at the center position thereof so that the first locking plate 40 and the second locking plate 50 are both pushed away by the pawl 30 to detach from the engaging teeth 21 of the ratchet wheel 20 so that the ratchet wheel 20 can be rotated freely.

Figure 6:
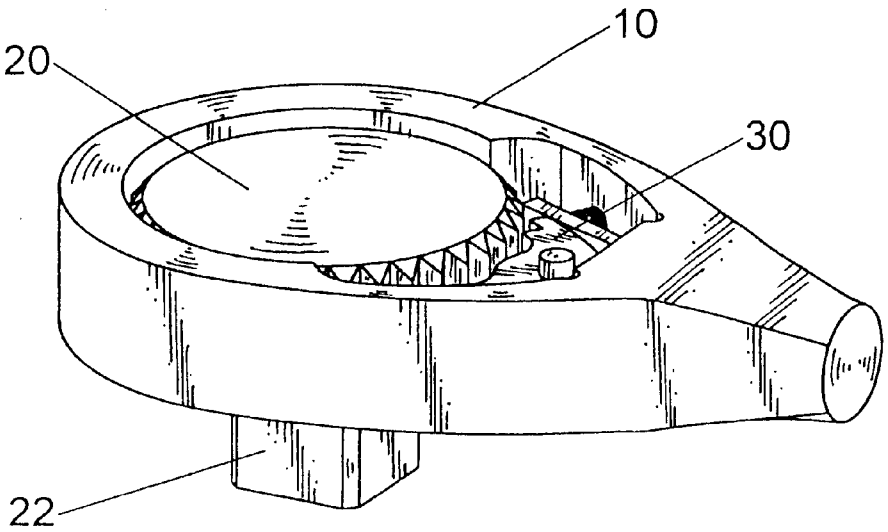
FIG. 6 is a perspective view of the ratchet wrench structure in accordance with another embodiment of the present invention.

Referring to FIG. 6, in accordance with another embodiment of the present invention, the ratchet wheel 20 is provided with a polygonal shank 22 protruding outward therefrom to fit a socket (not shown) for rotating screw members.

Accordingly, according to the present invention, the first tooth 31 of the pawl 30 co-operates with the first mating tooth 41 of the first locking plate 40 to mesh with the engaging teeth 21 of the ratchet wheel 20, or alternatively, the second tooth 32 of the pawl 30 co-operates with the second mating tooth 51 of the second first locking plate 50 to mesh with the engaging teeth 21 of the ratchet wheel 20, thereby enhancing the engaging strength of the ratchet wheel so that the ratchet wrench structure can be used to withstand and tolerate a larger torque.

It should be clear to those skilled in the art that further embodiments may be made without departing from the scope of the present invention.

What is claimed is:

1. A ratchet wrench structure comprising:

a wrench head (10) defining a receiving hole (11), said receiving hole (11) having one side defining a receiving chamber (12);

a ratchet wheel (20) rotatably mounted in said receiving hole (11) and having an outer periphery provided with a plurality of engaging teeth (21);

a pawl (30) pivotally mounted in said receiving chamber (12) to rotate through a small angle and having a first side provided with a first tooth (31) meshing with said engaging teeth (21) of said ratchet wheel (20), and a second side provided with a second tooth (32) meshing with said engaging teeth (21) of said ratchet wheel (20);

a first locking plate (40) mounted in said receiving chamber (12) and rested on said first side of said pawl (30);

a first elastic member (60) mounted in said receiving chamber (12) and pressed between said first locking plate (40) and an inner wall of said receiving chamber (12);

second locking plate (50) mounted in said receiving chamber (12) and rested on said second side of said pawl (30); and a second elastic member (70) mounted in said receiving chamber (12) and pressed between said second locking plate (50) and said inner wall of said receiving chamber (12).

2. The ratchet wrench structure in accordance with claim 1, further comprising a pivot axle (34) pivotally mounted in said receiving chamber (12) and secured in said pawl (30) so that said pawl (30) is rotated with said pivot axle (34).

3. The ratchet wrench structure in accordance with claim 1, wherein said receiving chamber (12) has a distal end defining a small hole (13), and said ratchet wrench structure further comprises a ball (80) received in said small hole (13) and rested on a bottom of said pawl (30), and a spring (81) received in said small hole (13) and pressed between said ball (80) and a wall of said small hole (13).

4. The ratchet wrench structure in accordance with claim 1, wherein said first locking plate (40) has a distal end provided with a first mating tooth (41) aligning with said first tooth (31) of said pawl (30) and meshing with said engaging teeth (21) of said ratchet wheel (20).

5. The ratchet wrench structure in accordance with claim 1, wherein said second locking plate (50) has a distal end provided with a second mating tooth (51) aligning with said second tooth (32) of said pawl (30) and meshing with said engaging teeth (21) of said ratchet wheel (20).

6. The ratchet wrench structure in accordance with claim 1, wherein said ratchet wheel (20) defines a polygonal recess (22) in a center thereof.

7. The ratchet wrench structure in accordance with claim 1, wherein said ratchet wheel (20) is provided with a polygonal shank (22) protruding outward therefrom.

* * * * *